US005633565A

United States Patent [19]

Friedman et al.

[11] Patent Number: 5,633,565

[45] Date of Patent: May 27, 1997

[54] ELECTRONIC FLASHER CIRCUIT

[75] Inventors: Roni Friedman, Petach Tikva; Chaim Chacham, Rishon Lezion, both of Israel; William F. Richardson, Jr.; Brian N. Raymond, both of East Haven, Conn.

[73] Assignee: Interplex Solar, Inc., Flushing, N.Y.

[21] Appl. No.: 300,727

[22] Filed: Sep. 2, 1994

Related U.S. Application Data

[63] Continuation-in-part of Ser. No. 905,513, Jun. 29, 1992, abandoned.

[30] Foreign Application Priority Data

Dec. 18, 1991 [IL] Israel ..... 100406

[51] Int. Cl.[6] ..... H05B 37/00; F21L 7/00; G09F 13/00

[52] U.S. Cl. ..... 315/200 A; 315/150; 315/152; 315/159; 362/275; 40/442; 136/291

[58] Field of Search ..... 362/183, 275, 362/295; 315/200 A, 159, 360, 149, 150, 152–154, 156–157; 340/908.1, 908; 40/442; 136/243, 244, 251, 291

[56] References Cited

U.S. PATENT DOCUMENTS

| | | | |
|---|---|---|---|
| D. 324,347 | 3/1992 | Williams | D10/114 |
| 4,384,317 | 5/1983 | Stackpole | 362/183 |
| 4,718,185 | 1/1988 | Conlin et al. | 362/183 X |
| 4,748,756 | 6/1988 | Ross | 40/715 |
| 4,751,622 | 6/1988 | Williams | 362/183 |
| 4,756,106 | 7/1988 | Foster | 40/591 |
| 4,772,990 | 9/1988 | Linehan et al. | 362/183 |
| 4,782,610 | 11/1988 | Hillstrom et al. | 40/541 |
| 5,013,972 | 5/1991 | Malkieli et al. | 315/209 R |
| 5,204,586 | 4/1993 | Moore | 315/159 |
| 5,272,418 | 12/1993 | Howe et al. | 315/159 |

FOREIGN PATENT DOCUMENTS 199102 8/1958 Austria .

OTHER PUBLICATIONS

"555 Timer Appl. Source Book with Experiments" by H. M. Berlin, Howard Sams & Coi, Inc 1979 pp. 126–127 & 68–69.

*Primary Examiner*—Robert Pascal
*Assistant Examiner*—Arnold Kinkead
*Attorney, Agent, or Firm*—Darby & Darby

[57] ABSTRACT

An electrical flasher circuit has improved operating characteristics, in particular by providing continuous illumination for a long period of time from a fully charged solar battery. The circuit employs a solar battery recharging circuit component that achieves full charge in a short period of time. The flasher circuit may be used in roadside warning device having a sign member with a warning image. Placed around the warning image are a plurality of light emitters for providing a visual warning during evening and night hours. The light emitters are powered by a solar energy source connected to a flasher circuit including an oscillator for causing the light emitters to be energized in a particular sequence. When the device is exposed to sunlight, the battery is disconnected to avoid unnecessary draining of the battery.

19 Claims, 5 Drawing Sheets

ELECTRONIC FLASHER CIRCUIT

This application is a continuation-in-part of U.S. patent application Ser. No. 07/905,513 filed Jun. 29 1992 now abandoned.

FIELD OF THE INVENTION

This invention relates to an electrical flasher circuit and, in particular, to a miniature electrical flasher circuit suitable for use in standard roadside warning lamps.

BACKGROUND OF THE INVENTION

Roadside warning lamps employing flashing lamps powered by a standard rechargeable car battery are known and are commonly used by road construction workers to alert drivers to the onset of hazardous conditions resulting from road works.

Such warning lamps usually conform to a standard physical dimension and light output which, in combination, has so far militated against the battery being incorporated within the lamp housing itself and has required, instead, that the battery be provided as a completely separate unit.

This limitation results from the fact that in order to provide the required light output, a sufficiently powerful battery is a prerequisite and, so far, this has demanded a relatively large 12 V rechargeable battery having a large ampere-hour rating. Typical roadside warning lamps of the type described are manufactured under the trade name "horizontal SIGNAL" and have standard dimensions of 21 cm in diameter and 21 cm in depth and this, obviously, is too small to accommodate therein such batteries.

A miniature flashing light for mounting on a curb is known such as is manufactured under the trade mark SWAREFLEX which includes therein an LED solar-powered flasher and a storage battery for storing electrical energy transformed by a solar cell. The storage battery has a capacity of 14 days power consumption when fully charged. In order to become fully charged, fine weather (corresponding to intense ambient illumination) is required for a minimum of four days. Likewise, there exist many similar solar-powered lamps employing rechargeable batteries but none has been found suitable for replacing roadside warning lamps of the type described owing to the stringent size and light output specifications associated therewith.

SUMMARY OF THE INVENTION

It is an object of the invention to provide an electrical flasher circuit suitably dimensioned that it can fit within a standard roadside warning lamp housing.

It is a further object of the invention to provide such an electrical flasher circuit which has improved operating characteristics over hitherto proposed flasher circuits, in particular by providing continuous illumination which meets the stringent light output requirements for a roadside warning lamp, for a longer period of time from a fully charged battery and employing a battery recharging facility which achieves full charge in a very much lower period of time than has been achieved with hitherto proposed systems.

According to the invention there is provided an electrical flasher circuit, comprising:

rechargeable battery, solar panel coupled to the rechargeable battery, a timer circuit coupled to the rechargeable battery and to the solar panel for periodically turning a lamp on and off at a predetermined frequency, at least one lamp or LED coupled to the timer circuit for flashing in response to the oscillating output voltage;

whereby the solar panel provides sufficient power to energize the timer circuit and to recharge the rechargeable battery when at least a predetermined threshold of light acts on the solar panel, and the rechargeable battery alone energizes the timer circuit for at least a first predetermined time period in the absence of said light.

In accordance with a preferred embodiment of the invention, the timer circuit includes an integrated circuit in combination with a transistor amplifier for providing sufficient output current for energizing the lamp. Furthermore, current is supplied to the lamp for only about 16% of the timer period, the current consumption being substantially zero for the remainder of the period. Such a design facilitates miniaturization, the circuit permitting the rechargeable battery to become fully charged quickly and then to continue operating continuously for several days even in the absence of ambient illumination.

BRIEF DESCRIPTION OF THE DRAWINGS

For a clearer understanding of the invention and to see how the same may be carried out in practice, embodiments will now be described, by way of non-limiting examples only, with reference to the accompanying drawings, in which.

DETAILED DESCRIPTION OF PREFERRED EMBODIMENT

Figure 1:
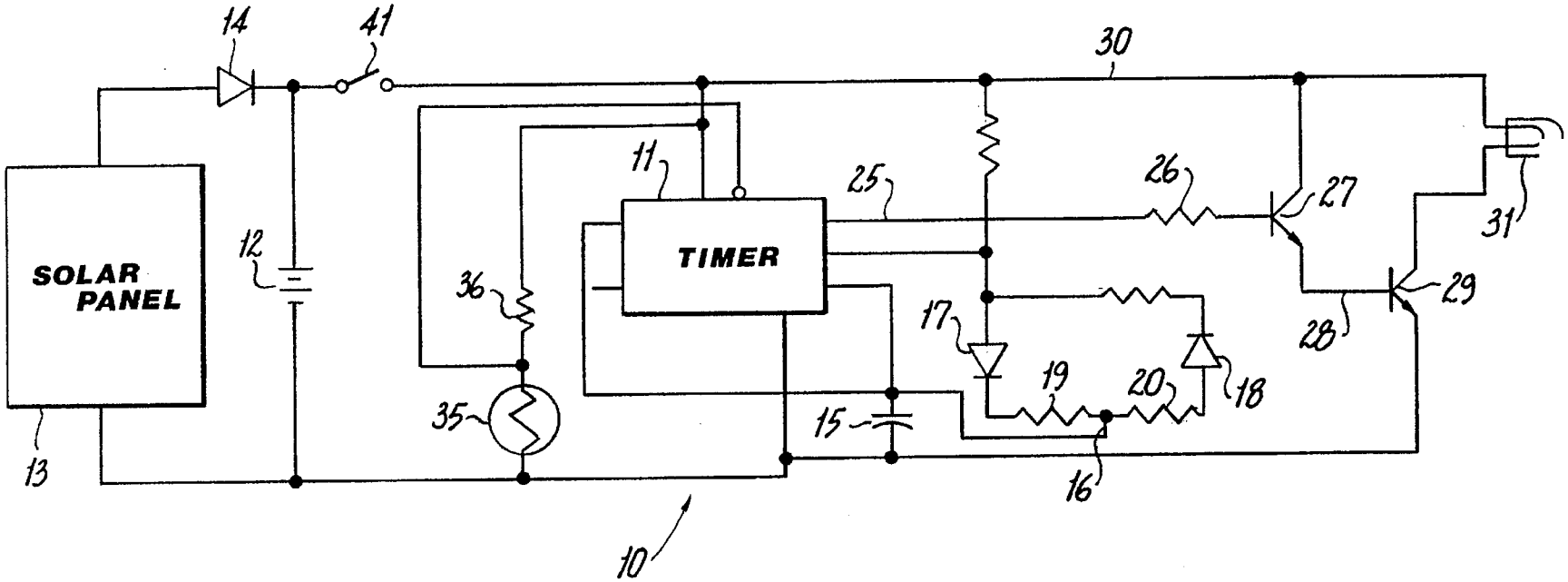
FIG. 1 shows schematically an electrical circuit diagram of a flasher circuit according to one embodiment of the invention.

Referring to FIG. 1 there is shown schematically a circuit diagram of a roadside flasher circuit designated generally as 10. The flasher circuit 10 comprises an integrated circuit timer 11 such as an LM555 integrated circuit manufactured by National Semiconductor and having a nominal low voltage operation, such as 4.5 V, and a low current drain, such as 3 mA average. The timer 11 is used to periodically turn a lamp on and off. Connected to the integrated circuit timer 11, is a rechargeable battery 12 having a nominal voltage of about 2.9 V and rated at about 6 AH. The rechargeable battery 12 is trickle charged by a solar panel 13 having a nominal voltage, such as 15 V and rated at about 1 A, via a rectifier diode 14 which prevents reverse current flowing from the rechargeable battery 12 to the solar panel 13. The timer circuit has a nominal current drain under about 0.5 mA and is preferably operative from a supply voltage in excess of about 0.5 V.

The output timing waveform of the integrated circuit timer 11 is controlled by a capacitor 15 in series with a diode-resistor network 16 comprising diodes 17 and 18 in series with resistors 19 and 20. Diodes 17 and 18 may be conventional germanium rectifier diodes, while the values of the resistors 19 and 20 may be respectively 2.5 MΩ and 0.5 MΩ. The capacitor 15 may have a value of 0.66 μF and is connected to the junction of the two resistors 19 and 20.

The capacitor 15 is connected to the resistor 19 via the diode 17 and to the resistor 20 via the diode 18. The two diodes 17 and 18 are connected in opposite sense so that, during a charge stage having a time constant determined by the resistor 19, current flows through the diode 17 while, during a discharge stage having a time constant determined by the resistor 20, current flows through the diode 18. In such an arrangement, current flows for only about ⅙ th of the timer period, i.e. an approximately 16% duty cycle, wherein the output timing waveform of the timer 11 is active for about 16% or ⅙ th of the timer period. The output timing waveform of the timer 11 is thus inactive for the remaining ⅚ th of the timer period.

An output 25 of the integrated circuit timer 11 is connected, via a resistor 26 to the base of a first transistor 27, which may be a bipolar junction transistor, whose emitter 28 is connected to the base of a second transistor 29, which may also be a bipolar junction transistor. The collector of the first bipolar junction transistor 27 is connected to a positive supply rail and a lamp 31, which may be rated at 2.4 V, 330 mA, is connected between the positive supply rail 30 and the collector of the second bipolar junction transistor 29.

The first bipolar junction transistor 27 functions as a switch which operates under control of the integrated circuit timer 11 for supplying current to the lamp 31 during the minor part of the timer period and is cut-off during the remainder of the timer period for preventing the supply of current to the lamp 31. This results in a duty cycle of approximately 16%. The second bipolar junction transistor 29 functions as an amplifier for providing enough current to drive the lamp 31.

A photoresistor 35 (constituting a light-dependent resistor) in series with a current-limiting resistor 36 is connected to the integrated circuit timer 11 so as to permit operation of the integrated circuit timer 11 only when the ambient light falls below a predetermined threshold. By this means, operation of the roadside warning lamp (see FIG. 2) may be restricted to nighttime use only, thereby conserving the battery 12.

By adjusting the value of the capacitor 15, the oscillation frequency of the lamp 31 may be raised above the critical frequency of fusion, (approximately 25 Hz), so that any flicker of the lamp 31 is undetectable by the human eye.

Figure 2B:
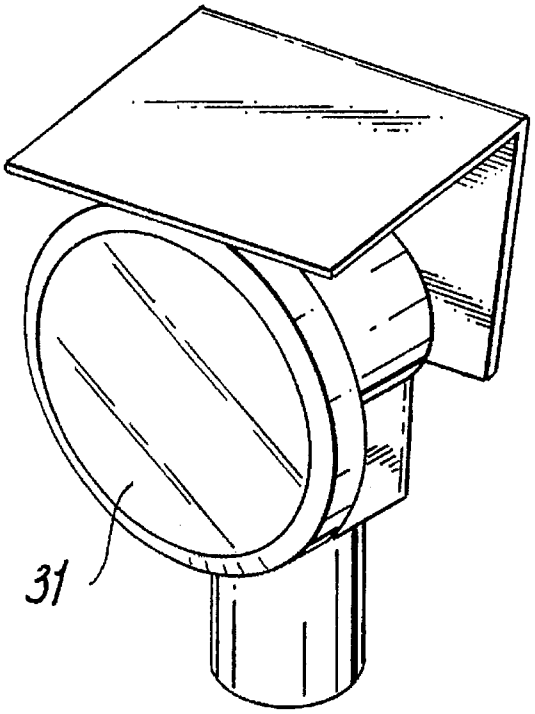
FIGS. 2*a* and 2*b* are pictorial representations of a roadside warning lamp incorporating the flasher circuit shown in FIG. 1.
Figure 2A:
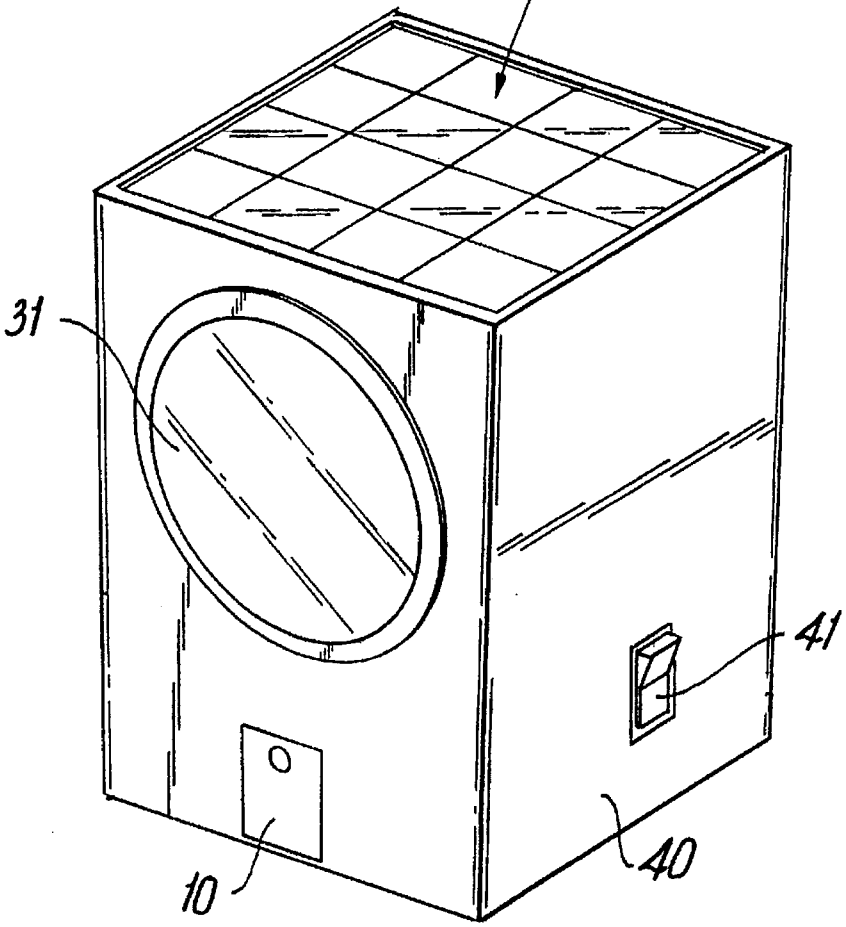

FIG. 2 shows a conventional type of roadside lamp 31 fitted within a housing 40 containing therein the flasher circuit 10 described above with reference to FIG. 1 of the drawings. The rechargeable battery 12 and the lamp 31 are both fitted within the housing 40 and the solar panel 13 is mounted on an upper surface thereof. A switch 41 fixed to the housing 40 permits the battery 12 to be disconnected from the flasher circuit 10, thereby conserving battery power.

During daylight hours, the solar panel 13 recharges the internal battery 12 such that in the presence of sufficient ambient illumination, the solar panel 13 is alone responsible for providing power to the flasher circuit 10 (FIG. 1), any residual solar energy being used to trickle charge the rechargeable battery 12 and maintain it fully charged. With the component values described above with reference to FIG. 1 of the drawings, the battery 12 is fully charged within 3½ hours' illumination on a bright day. Under these circumstances, there is enough charge in the battery 12 to operate the circuit for three consecutive nights (i.e. in the absence of ambient illumination) for an average of 18 hours each night.

Whenever the ambient light falls below the predetermined threshold established by the photoresistor 35, the lamp 31 flashes continuously so as to provide a visual warning to motorists and pedestrians and thus to enhance their safety. The flashing rate of the lamp 31 may be adjusted so that the lamp either appears to be continuously illuminated or appears to be flashing on and off. When the flash rate is above the critical frequency of fusion, the flashing will not be detected by the human eye. Rather, the lamp 31 will appear to be continuously illuminated. If the flashing rate is below the critical frequency of fusion, the flashing of the lamp 31 will be visually perceptible and the lamp will appear to be turning on and off.

Both the diameter and depth of the lamp 31 are nominally 21 cm and the lamp 31 may be, in all outward respects, identical to that currently employed in standard roadside warning lamps.

It will further be noted that the miniaturization of the flasher circuit 10 permits the battery 12 to be of such dimension that it too can be accommodated within the housing 40. This, of course, is distinct from hitherto proposed roadside warning lamps of comparable light output which require much larger batteries which must be provided as a separate unit.

Figure 3:
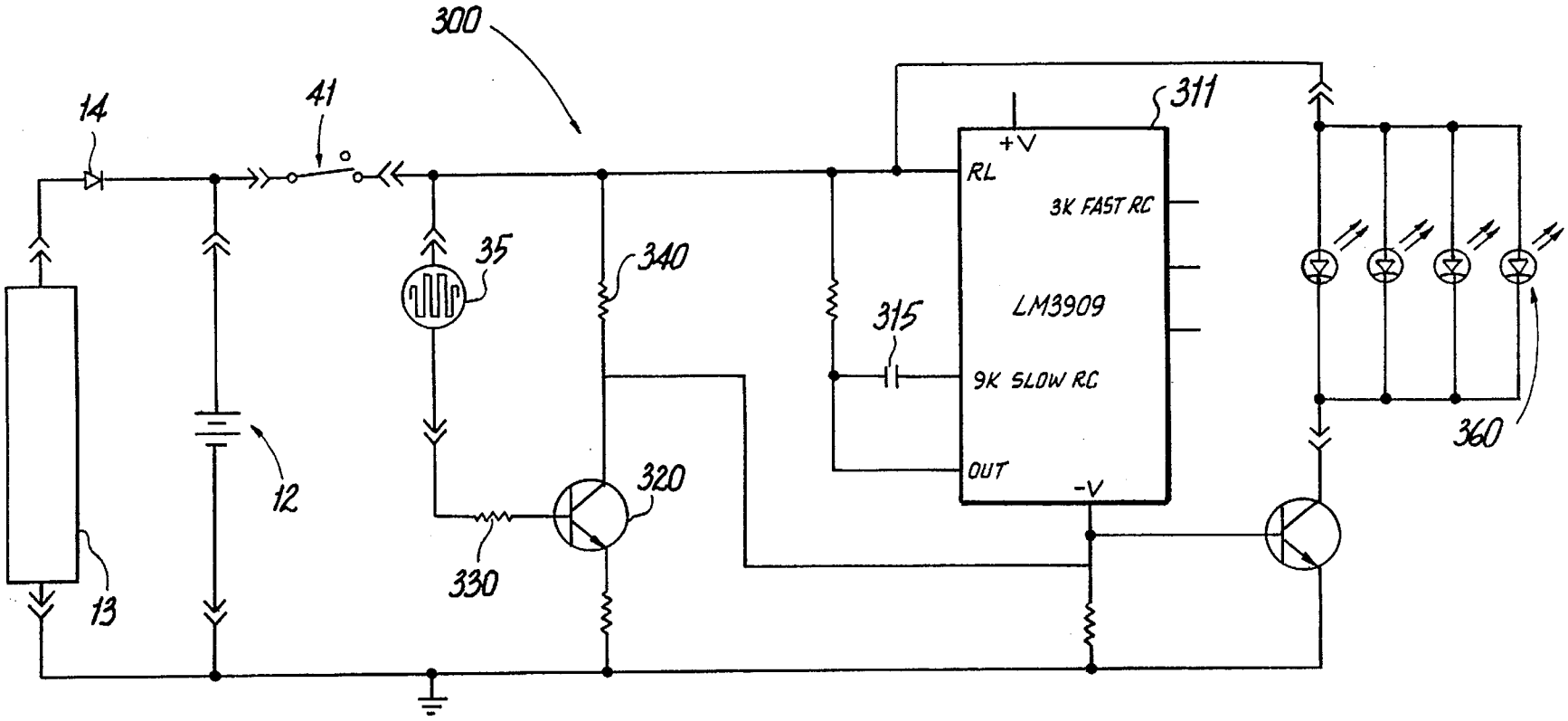
FIG. 3 shows schematically an electrical circuit diagram of an alternative embodiment of a flasher circuit according to the invention.

Referring to FIG. 3, there is shown schematically a circuit diagram of an alternative embodiment of a roadside flasher circuit designated generally as 300. The flasher circuit 300 is similar in operation to the flasher circuit 10 of FIG. 1. Accordingly, only the major differences between the two circuits need be discussed. First, flasher circuit 300 utilizes a timer 311 which is similar to the timer 11 of FIG. 1. However, the timer 11 is preferably an LM555 integrated circuit, whereas the timer 311 is preferably an LM3909 integrated circuit.

Additionally, the flasher circuit 300 includes transistor 320 and resistors 330 and 340 which form a precise on/off circuit for accurately enabling and disabling the timer 311. During periods of marginal ambient light, such as at dusk and dawn, the output of photoresistor 35 may be such that the LEDs 360 flicker on and off as the output voltage of photo-resistor 35 changes about the trigger point of timer 311. This problem is avoided by having the output of photoresistor 35 drive the base input of transistor 320 through resistor 330. The output or collector of transistor 320, which is biased to the power supply voltage through resistor 340, is then used to control the timer 311. Transistor 320 typically has a relatively precise turn-on voltage and will therefore be immune to the photoresistor 35 voltage fluctuations at its base, and thus provide a stable control signal to the timer 311. In this way, the flasher circuit is turned on and off precisely, even though the photoresistor output voltage is varying slightly.

Figure 4:
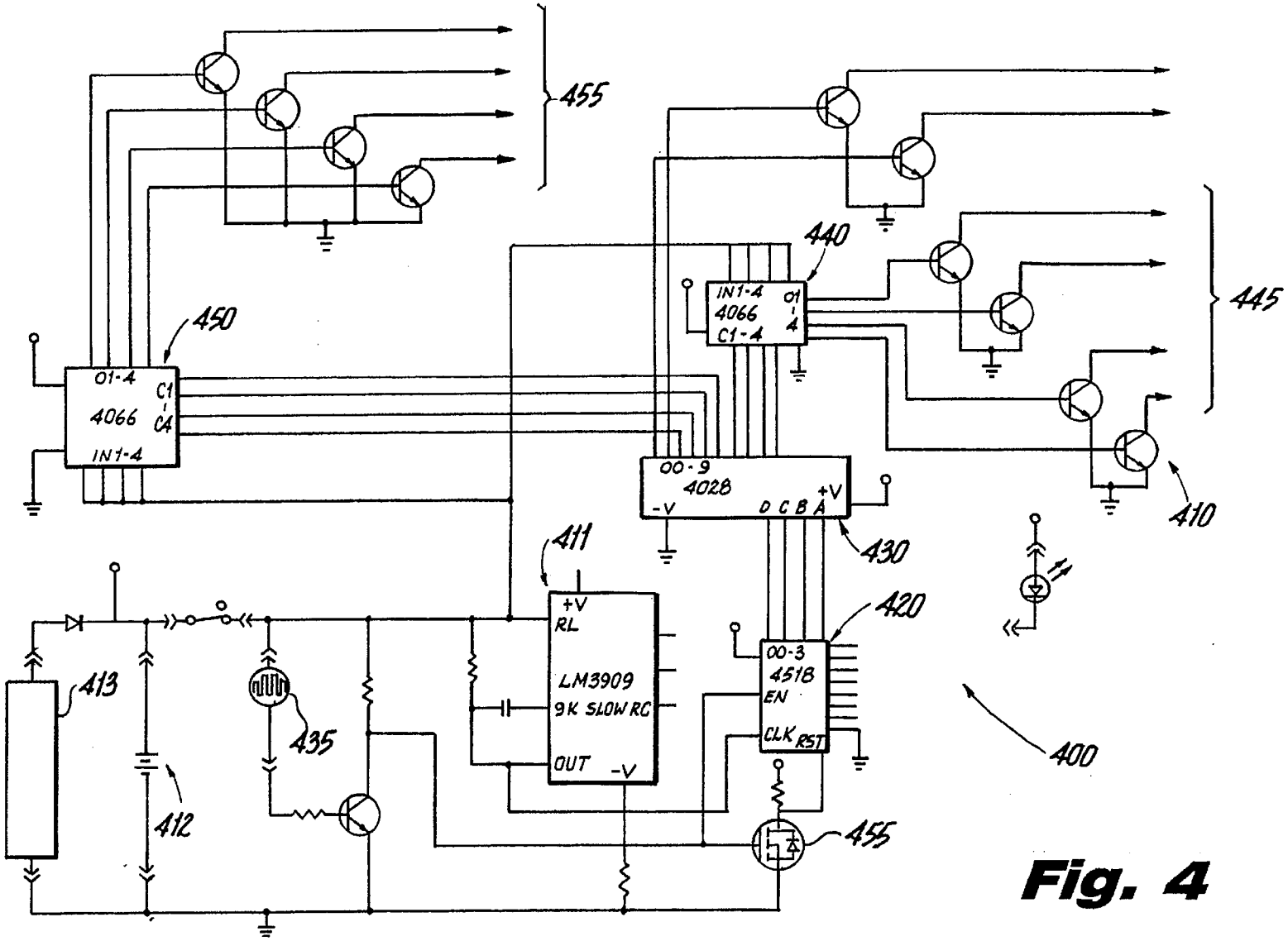
FIG. 4 shows schematically an electrical circuit diagram of another alternative embodiment of a flasher circuit according to the invention.
Figure 5:
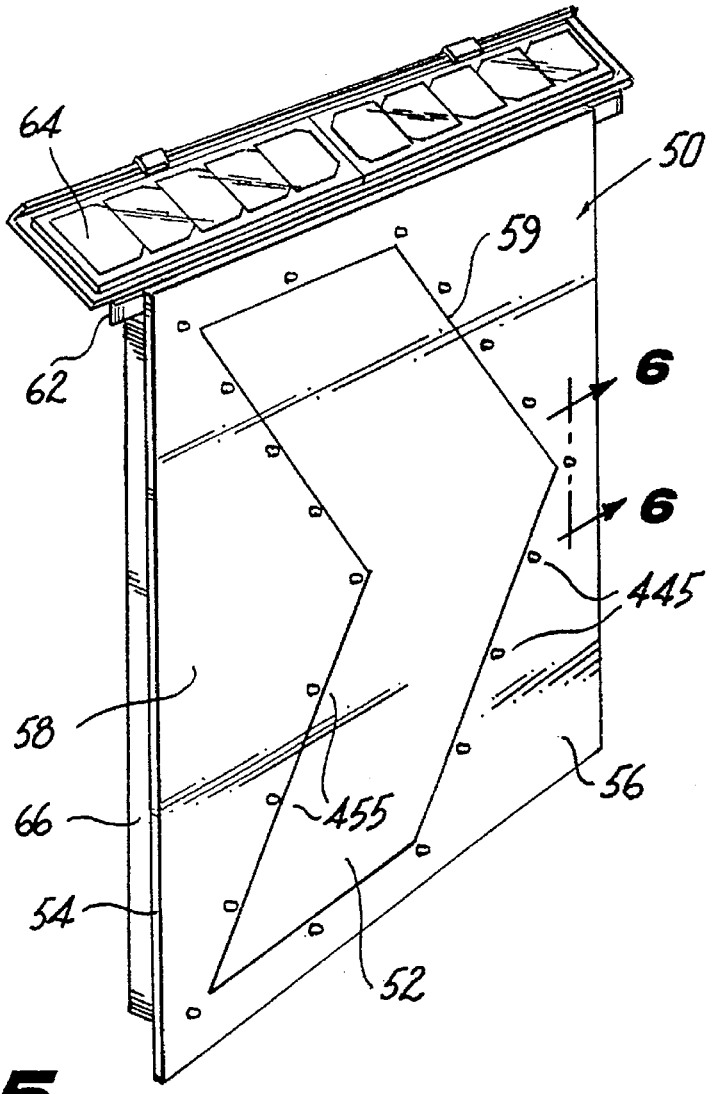
FIG. 5 is a perspective view of a roadside warning device according to an alternative embodiment of the present invention.

Referring to FIG. 4, there is shown schematically a circuit diagram of an alternative embodiment of a roadside flasher circuit designated generally as 400. The flasher circuit 400 is similar in operation to the flasher circuit 300, except that the flasher circuit 400 is used to control a bank of several LEDs 410. The LEDs 410 may be arranged in a specific pattern so as to provide a correspondingly illuminated pattern. For example, the LEDs 410 may be arranged in the form of one or more arrows, as indicated in FIG. 5. In this way, an arrow pattern may be repeatedly flashed when used with the light flasher circuit 400.

As shown in FIG. 4, light flasher circuit 400 includes an up/down counter 420 which controls the LED banks 410 such that they are illuminated sequentially, thereby creating the effect of a moving or directional arrow as the LED banks 410 are illuminated one after the other. The output of counter 420, which is in binary form, is converted to decimal output by binary to decimal (BCD) converter 430. The outputs of BCD converter 430 are then used to selectively energize the LEDs 410 through analog switches 440 and 450 in accordance with the timing control signal output by counter 420. In this way, switch 450 may be used to control LED bank 455, while switch 440 controls bank 445, in the case of a two bank or two segment arrow pattern or chevron image, such as that shown in FIG. 5.

Figure 6:
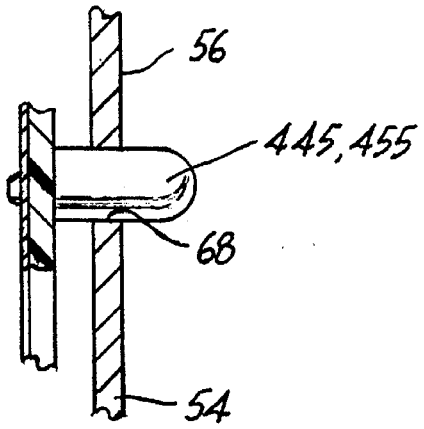
FIG. 6 is a fragmentary cross-sectional view taken along line 6—6 of FIG. 5.

Referring now to FIGS. 5 and 6, a road side warning device 50 is provided having a combination of a printed image and battery-powered light emitters. In a preferred embodiment, a road sign includes a printed chevron-shaped image 52 on a sign member 54, preferably on a front face 56. According to government standards for road signs, the background 58 is yellow, while the chevron 52 is printed in black, although these colors may be varied.

Along the perimeter 58 of the image 52 are a plurality of light emitters 445 and 455, preferably evenly spaced around the perimeter 58. Mounted along the top edge 62 of the sign 54 is a solar panel 64 that is preferably angled to maximize the sun's exposure on the solar panel 64 throughout the daylight hours. Attached to the rear face of the sign 54 is a housing 66 for containing the circuitry 400 (see FIG. 4) used for powering the light emitters 60. Preferably, the light emitters 445 and 455 are inserted through holes 68 drilled in the front face 56 of the sign 54 (see FIG. 6), with the electrical connections of the emitters 445 and 455 extending behind the front face 56.

Although in the preferred embodiment shown in FIGS. 4–6, there are two LED banks 445 and 455 being controlled, the present invention may be used in general for multiple LEDs which may be independently turned on and off. This allows for maximum flexibility in creating a specific sign or output format whose lighting is to be controlled. Additionally, while the above description of the preferred embodiment discusses sequential flashing of two banks of LEDs, the present invention can also be used to sequentially flash LEDs around the perimeter of the image. Of course, other flashing arrangements and other placements of the LEDs with respect to the image are contemplated by the present invention. Depending on the particular flashing arrangement, it may not be necessary for all the LEDs to be energized.

The light flasher circuit 400 also includes a reset or clear circuit for completely disabling all the banks of LEDs when photoresistor 435 detects a sufficient amount of light indicating that the LEDs should be turned off. The reset circuit includes transistor 455 which is indirectly driven by photoresistor 435 to activate the reset input of counter 420. Thus, when photoresistor 435 detects a sufficient amount of light, counter 420 is disabled, and accordingly, all the banks of LEDs 410, such as banks 445 and 455, are also disabled.

If the reset circuit were not in place, it is possible that if the photoresistor signal indicating the presence of a sufficient amount of light occurred while one of the LED banks was enabled, the light flasher circuit may remain in a "hung-up" state where one of the LED banks is permanently lit, at least until the photoresistor enables the operation of the circuit. However, this problem is avoided by adding the reset circuit of the present invention.

In yet another alternative embodiment of the present invention, the light flasher circuit is used to repeatedly flash a lamp or LED on and off; however, the flashing is at a rate which is above the critical or fusion frequency, such that to the human eye it appears that the lamp or LED is being continuously illuminated. In this embodiment, which may be referred to as a "steady burn" circuit, capacitor 315 (FIG. 3) is changed in size. Specifically, the size of capacitor 615 is reduced in order to increase the operational frequency of timer 311, such that the operational frequency at which the LED 360 is flashed on and off is above the critical frequency of fusion (approximately 25 Hz). In this way, the LED 360 may be flashed on and off in order to conserve power, yet the flashing is at such a high frequency that it is undetectable by the human eye, and the LED 360 appears to be continuously lit.

One of the advantages of this embodiment is unattended, continuous operation, with only minimal sunlight required. Since the LEDs are placed in position around the perimeter of the image, the image of the sign can be seen in both daylight and at night. During daylight hours, the image itself can be easily seen, while at night, the LEDs will not only form the outline of the image, but will also shine a small amount of light on the sign itself, giving a viewer a further indication of the intended warning of the sign.

Of course, other sign shapes, such as "Stop" signs, "One Way" signs, or "Do Not Enter" signs, are contemplated by the present invention. In some of those cases, the LEDs may be placed around the perimeter of the entire sign, since the shape of the sign is fully indicative of its warning. For example, the octagonal shape of a "Stop" sign is a universal symbol, so that, it would be unnecessary for the LEDs to be placed around the letters "STOP", but can be placed around the perimeter of the red image printed on the sign.

While these embodiments are fully enabled and fully capable of achieving the objects and advantages of the invention, it is to be understood that these embodiments are shown for the purpose of illustration, not for limitation. Many other embodiments and modifications will be apparent to those skilled in the art that remain within the scope of the invention, that scope being only limited by the claims, as follows:

What is claimed is:

1. An electrical flasher circuit, comprising:

a rechargeable battery;

a solar panel coupled to the rechargeable battery;

a timer circuit coupled to the rechargeable battery and to the solar panel for producing an output voltage which changes periodically between an on state and an off state and is on during a minor portion of a period of said output voltage;

at least one lamp coupled to the timer circuit, and means for causing said at least one lamp to repeatedly flash between a visually perceptible on state and an off state in response to the output voltage;

the solar panel providing sufficient power to energize the timer circuit and to recharge the rechargeable battery when at least a predetermined threshold of light acts on the solar panel, and the rechargeable battery alone energizing the timer circuit for at least fifty hours when the rechargeable battery is fully charged in the absence of said light;

means including a light dependent resistor coupled to a transistor switch coupled to the timer circuit for permitting the timer to function only when an ambient light level falls below a predetermined threshold and said means preventing astable operation when the ambient light level fluctuates about the predetermined threshold, said light dependent resistor and said transistor switch being continuously energized by said solar panel for continuously monitoring said ambient light level, said means further comprising a reset circuit for disabling said at least one lamp when the light dependent resistor indicates that the ambient light level is below the predetermined threshold.

2. The flasher circuit according to claim 1, wherein said minor portion of a period is between 5% to 20%.

3. The flasher circuit according to claim 1, wherein: the rechargeable battery has a nominal voltage of approximately 2.9 volts and a nominal current rating of approximately 6 ampere hours, the solar panel has a nominal current rating of at least 1 ampere and a nominal voltage of about 15 volts, the timer circuit has a nominal current drain under about 0.5 milliamperes and is operative from a supply voltage in excess of 0.5 volts, said at least one lamp has a nominal voltage of 2.4 volts and having a nominal drive current of 330 milliamperes.

4. The flasher circuit according to claim 1, wherein the solar panel substantially completely recharges the rechargeable battery when light acts on the solar panel for at least 3½ hours.

5. The flasher circuit according to claim 1, wherein: the timer circuit includes an LM3909 integrated circuit, and an amplifier is provided having an input coupled to an output of the LM3909 integrated circuit and having an output coupled to said lamp for amplifying an output current of the LM3909 integrated circuit in order to provide sufficient current to energize the lamp.

6. An electrical flasher circuit, comprising:

a rechargeable battery;

a solar panel coupled to the rechargeable battery;

a timer circuit coupled to the rechargeable battery and to the solar panel for producing an output voltage which changes periodically between an on state and an off state and is on during a minor portion of a period of said output voltage;

at least one lamp coupled to the timer circuit, and means for causing said at least one lamp to repeatedly flash between an on state and an off state in response to the output voltage;

the solar panel providing sufficient power to energize the timer circuit and to recharge the rechargeable battery when at least a predetermined threshold of light acts on the solar panel, and the rechargeable battery alone energizing the timer circuit in the absence of said light for at least fifty hours when the rechargeable battery has been fully charged;

means including a light-dependent resistor coupled to a transistor switch coupled to the timer for permitting the timer to function only when an ambient light level falls below a predetermined threshold and said means preventing astable operation when the ambient light level fluctuates about the predetermined threshold, said light dependent resistor and said transistor switch being continuously energized by said solar panel for continuously monitoring said ambient light level, said means further comprising a reset circuit for disabling said at least one lamp when the light dependent resistor indicates that the ambient light level is below the predetermined threshold;

wherein said period of said timer circuit is sufficiently short such that the rate at which said lamp repeatedly flashes is greater than the critical frequency of fusion.

7. An electrical flasher circuit according to claim 1, further comprising:

a housing for accommodating therein said at least one lamp, said housing having a depth substantially no greater than 21 cm and a diameter substantially no greater than 21 cm, said housing also accommodating said rechargeable battery, said solar panel coupled to said rechargeable battery, and said timer circuit, said timer circuit being coupled to said rechargeable battery and to said solar panel for producing an output voltage which changes periodically between an on state and an off state and is on during a minor portion of a period of said voltage.

8. An electrical flasher circuit according to claim 7, wherein said minor portion of said period is between 5% to 20%.

9. An electrical flasher circuit according to claim 7, wherein the solar panel is fixed to an outer surface of the housing.

10. An electrical flasher circuit according to claim 7, wherein the solar panel substantially completely recharges the rechargeable battery when light acts on the solar panel for at least 3½ hours.

11. An electrical flasher circuit according to claim 7, wherein the timer circuit includes an LM3909 integrated circuit, and further comprising an amplifier having an input coupled to an output of the LM3909 integrated circuit and having an output coupled to said lamp for amplifying an output current thereof in order to provide sufficient current to energize the lamp.

12. An electrical flasher circuit according to claim 6 further comprising:

a housing for accommodating therein a lamp, said housing having a depth substantially no greater than 21 cm and a diameter substantially no greater than 21 cm, said housing also accommodating a rechargeable battery, a solar panel coupled to the rechargeable battery, a timer circuit coupled to the rechargeable battery and to the solar panel for producing an output voltage which changes periodically between an on state and an off state and is on during a minor portion of a period of said voltage.

13. An electrical flasher circuit comprising:

a rechargeable battery;

a solar panel coupled to the rechargeable battery;

a timer circuit coupled to the rechargeable battery and to the solar panel for producing an output voltage which changes periodically between an on state and an off state and is on during a minor portion of a period of said output voltage;

at least one lamp coupled to the timer circuit, and means for causing said at least one lamp to repeatedly flash between a visually perceptible on state and an off state in response to the output voltage;

the solar panel providing sufficient power to energize the timer circuit and to recharge the rechargeable battery when at least a predetermined threshold of light acts on the solar panel, and the rechargeable battery alone energizing the timer circuit for at least a first predetermined time in the absence of said light after the rechargeable battery is fully charged;

means including a light dependent resistor coupled to a transistor switch, the transistor switch being coupled to the timer for permitting the timer to function only when an ambient light level falls below a predetermined threshold and said means preventing astable operation when the ambient light level fluctuates about the predetermined threshold, said light dependent resistor and said transistor switch being continuously energized by said solar panel for continuously monitoring said ambient light level, said means further comprising a reset circuit for disabling said at least one lamp when the light dependent resistor indicates that the ambient light level is below the predetermined threshold.

14. An electrical flasher circuit according to claim 13 further comprising:

a plurality of LED arrangements coupled to the timer circuit, and means for causing said plurality of LED arrangements to repeatedly flash between a visually perceptible on state and an off state in response to the output voltage, each of the plurality of LED arrangements being sequentially flashed to an on state after another of said plurality of LED arrangements.

15. An electrical flasher circuit, comprising:

a rechargeable battery;

a solar panel coupled to the rechargeable battery;

a timer circuit coupled to the rechargeable battery and to the solar panel for producing, an output voltage which changes periodically between an on state and an off state and is on during a minor portion of a period of said output voltage;

at least one lamp coupled to the timer circuit, and means for causing said at least one lamp to repeatedly flash at a visually imperceptible rate in response to the output voltage;

the solar panel providing sufficient power to energize the timer circuit and to recharge the rechargeable battery when at least a predetermined threshold of light acts on the solar panel, and the rechargeable battery alone energizing the timer circuit for at least a predetermined time in the absence of said light after the rechargeable battery is fully charged;

means including a light dependent resistor coupled to a transistor switch, the transistor switch being coupled to the timer for permitting the timer to function only when an ambient light level falls below a predetermined threshold and said means preventing astable operation when the ambient light level fluctuates about the predetermined threshold, said light dependent resistor and said transistor switch being continuously energized by said solar panel for continuously monitoring said ambient light level, said means further comprising a reset circuit for disabling said at least one lamp when the light dependent resistor indicates that the ambient light level is below the predetermined threshold.

16. A road sign warning device, comprising:

a sign member, said sign member having an indicator for indicating a particular condition;

a plurality of light emitters placed around the perimeter of the indicator;

a means for energizing said light emitters, said means for energizing powering said light emitters sequentially;

rechargeable solar energy means for providing power to said means for energizing said light emitters, said solar energy means including a photoelectric panel and a rechargeable battery;

a means for determining the ambient light level, said light level determining means including a light dependent resistor and a transistor switch preventing said energizing means from energizing said light emitters when said ambient light level is above a predetermined level and said means preventing astable operation when the ambient light level fluctuates about the predetermined threshold, said light dependent resistor and said transistor switch being continuously energized by said solar panel for continuously monitoring said ambient light level, said means further comprising a reset circuit for disabling said plurality of light emitters when the light dependent resistor indicates that the ambient light level is below the predetermined threshold; and wherein said photoelectric panel is mounted along a top edge of said sign member.

17. A roadsign warning device as in claim 16, wherein said plurality of light emitters are mounted on a sign member, said sign member having a warning image thereon.

18. A roadsign warning device as in claim 17, wherein said warning image has a perimeter and said plurality of light emitters are arranged along said perimeter of said image.

19. A roadsign warning device as in claim 18, wherein said minor portion of said period is between 5% and 20%.

* * * * *